US009936548B2

(12) United States Patent
Kuang et al.

(10) Patent No.: US 9,936,548 B2
(45) Date of Patent: Apr. 3, 2018

(54) SMART LED DRIVER AND LED DRIVE METHOD

(71) Applicant: Chengdu Monolithic Power Systems Co., Ltd., Chengdu (CN)

(72) Inventors: Naixing Kuang, Hangzhou (CN); Kai Wang, Hangzhou (CN); Qiming Zhao, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 0 days.

(21) Appl. No.: 15/629,675

(22) Filed: Jun. 21, 2017

(65) Prior Publication Data

US 2018/0007754 A1 Jan. 4, 2018

(30) Foreign Application Priority Data

Jun. 30, 2016 (CN) ..... 2016 1 0504209

(51) Int. Cl.
*H05B 33/08* (2006.01)

(52) U.S. Cl.
CPC ..... *H05B 33/0815* (2013.01); *H05B 33/0845* (2013.01); *H05B 33/0887* (2013.01)

(58) Field of Classification Search
CPC ..... H05B 37/02; H05B 37/0272; H05B 33/0887; H05B 33/0815; H05B 33/0845; H05B 33/0851; H05B 33/089; H05B 33/0824; H02M 3/3376; H02M 3/3385; H02M 3/156; H02M 3/33507; H02M 2001/0003; H02M 2001/0032; Y02B 20/347
USPC ..... 315/307, 291, 219, 247, 224, 278, 312, 315/DIG. 4; 363/21.13, 21.16, 21.17, 363/21.18
See application file for complete search history.

(56) References Cited

U.S. PATENT DOCUMENTS

| | | | | |
|---|---|---|---|---|
| 7,688,002 | B2 * | 3/2010 | Ashdown et al. | 315/291 |
| 8,503,139 | B2 | 8/2013 | Yao et al. | |
| 8,576,588 | B2 | 11/2013 | Kuang et al. | |
| 8,670,255 | B2 * | 3/2014 | Gong et al. | 363/89 |
| 8,760,080 | B2 * | 6/2014 | Yu | 315/297 |
| 8,896,214 | B2 | 11/2014 | Xu | |
| 9,035,566 | B2 | 5/2015 | Du et al. | |
| 9,215,769 | B2 | 12/2015 | Ren et al. | |
| 9,295,117 | B2 * | 3/2016 | Acatrinei | H05B 33/0815 315/307 |
| 9,408,265 | B2 * | 8/2016 | Xu et al. | H05B 33/0815 315/307 |
| 9,532,420 | B2 * | 12/2016 | Chen et al. | H05B 33/0815 315/291 |
| 9,661,700 | B2 | 5/2017 | Kuang et al. | |

* cited by examiner

*Primary Examiner* — Haissa Philogene
(74) *Attorney, Agent, or Firm* — Perkins Coie LLP

(57) ABSTRACT

A LED driver adopts one power stage to provide a constant drive current to drive a load, and to provide different power supply voltages to power a smart module according to a dimming signal input by users through the smart module. The LED driver provides high performance with simple circuit structure.

20 Claims, 5 Drawing Sheets

SMART LED DRIVER AND LED DRIVE METHOD

CROSS-REFERENCE TO RELATED APPLICATIONS

This application claims priority to and the benefit of Chinese Patent Application No. 201610504209.0, filed Jun. 30, 2016, which is incorporated herein by reference in its entirety.

FIELD

The present invention relates to electronic circuits, more specifically, the present invention relates to LED drivers.

BACKGROUND

As the development of technology, conventional fluorescent lamps are gradually replaced by LEDs (light emitting diodes) in applications such as LCD backlighting and lighting. In the application of smart LED lighting, a driver is needed to provide a controllable current. Different power supply voltages, such as 3.3V, 5V etc. are also needed to power smart modules (e.g. microcontroller unit (MCU), wireless module R/F, etc.) at different situations. In addition, when the LEDs are turned off, low standby power loss is required.

Thus, there is a need to provide different power supply voltages and to reduce the standby power loss in the smart LED lighting.

SUMMARY

It is an object of the present invention to provide a LED driver, which meets the above requirements.

In accomplishing the above and other objects, there has been provided, in accordance with an embodiment of the present invention, a LED driver, comprising: a power converter, configured to provide a drive current to drive a load in response to an input voltage, the power converter including a first winding and a main power switch; a second winding, magnetically coupled to the first winding to provide a first power supply voltage, the first power supply voltage being operable to power a wireless control module when a dimming signal is higher than a threshold signal; a third winding, magnetically coupled to the first winding to provide a second power supply voltage, the second power supply voltage being operable to power the wireless control module when the dimming signal is lower than the threshold signal; a first error amplifier, configured to generate a first compensation signal in response to a first reference signal and an equivalent output current indicative of the drive current, the first reference signal being controlled by the dimming signal; a second error amplifier, configured to generate a second compensation signal in response to a second reference signal and the second power supply voltage; and a control and drive circuit, configured to generate a control signal to control the main power switch in response to a compensation signal, the compensation signal being the first compensation signal when the dimming signal is higher than the threshold signal, and the compensation signal being the second compensation signal when the dimming signal is lower than the threshold signal.

In addition, there has been provided, in accordance with an embodiment of the present invention, a LED drive method, comprising: generating a drive current to drive a LED in response to an input voltage; comparing a dimming signal with a threshold signal; entering constant current mode if the dimming signal is higher than the threshold signal, so as to provide a constant drive current to the LED and to provide a first power supply voltage to power a wireless control module, the constant drive current and the first power supply voltage being both provided by a power stage; and entering constant voltage mode if the dimming signal is lower than the threshold signal, so as to provide a second power supply voltage to power the wireless control module by the power stage.

Furthermore, there has been provided, in accordance with an embodiment of the present invention, a LED driver, comprising: a power converter including a main power switch, configured to provide a drive current to drive a load, a first power supply voltage to power a wireless control module when a dimming signal is higher than a threshold signal, and a second power supply voltage to power the wireless control module when the dimming signal is lower than the threshold signal; and a control and drive circuit, configured to control the main power switch based on a first reference signal and an equivalent output current indicative of the drive current when the dimming signal is higher than the threshold signal, and to control the main power switch based on a second reference signal and the second power supply voltage when the dimming signal is lower than the threshold signal.

The use of the similar reference label in different drawings indicates the same of like components.

DETAILED DESCRIPTION

Embodiments of circuits for LED driver are described in detail herein. In the following description, some specific details, such as example circuits for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with circuits and methods that are meant to be exemplary and illustrative. In various embodiments, the above problem has been reduced or eliminated, while other embodiments are directed to other improvements.

Figure 1:
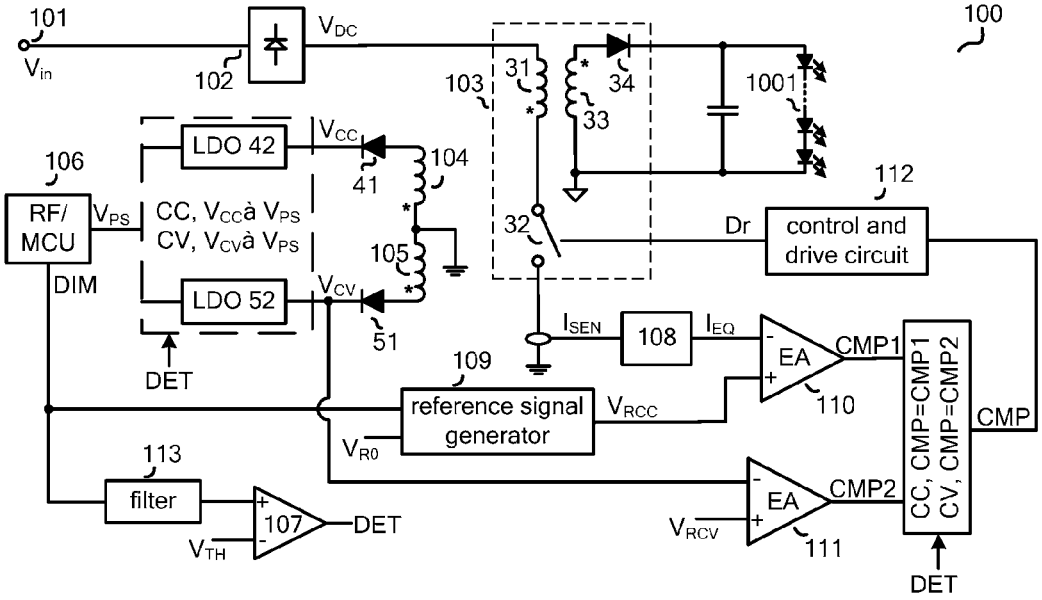
FIG. 1 schematically shows a LED driver 100 in accordance with an embodiment of the present invention.

FIG. 1 schematically shows a LED driver 100 in accordance with an embodiment of the present invention. In the example of FIG. 1, the LED driver 100 comprises: an input port 101, configured to receive an AC input voltage $V_{in}$; a rectifier 102, configured to receive the AC input voltage $V_{in}$ to provide a rectified signal $V_{DC}$; a power converter 103, configured to provide a drive current to drive a load (e.g. LED 1001), the power converter 103 including a first winding 31 and a main power switch 32 coupled to the first winding 31, wherein the first winding 31 is configured to store energy when the main power switch 32 is ON, and is configured to release the energy to the load when the main power switch 32 is OFF; a second winding 104, magnetically coupled to the first winding 31 to provide a first power supply voltage $V_{CC}$; a third winding 105, magnetically coupled to the first winding 31 to provide a second power supply voltage $V_{CV}$; a threshold comparator 107, configured to receive a dimming signal DIM from a wireless control module (RF/MCU) and a threshold signal $V_{TH}$, wherein the threshold comparator 107 is configured to generate a detected signal DET by comparing the dimming signal DIM with the threshold signal $V_{TH}$; an output current calculator 108, configured to calculate the drive current (i.e. load current) in response to a current flowing through the main power switch 32, to generate an equivalent output current $I_{EQ}$; a reference signal generator 109, configured to receive an original reference voltage $V_{R0}$ and the dimming signal DIM, to generate a first reference signal $V_{RCC}$, wherein the first reference signal $V_{RCC}$ is controlled by the dimming signal DIM; a first error amplifier (EA) 110, configured to receive the first reference signal $V_{RCC}$ and the equivalent output current $I_{EQ}$, to generate a first compensation signal CMP1 by amplifying and integrating a difference between the first reference signal $V_{RCC}$ and the equivalent output current $I_{EQ}$; a second error amplifier (EA) 111, configured to receive a second reference signal $V_{RCV}$ and a second power supply voltage $V_{CV}$, to generate a second compensation signal CMP2 by amplifying and integrating a difference between the second reference signal $V_{RCV}$ and the second power supply voltage $V_{CV}$; and a control and drive circuit 112, configured to receive a compensation signal CMP (the first compensation signal CMP1 or the second compensation signal CMP2) to generate a control signal Dr to control the main power switch 32; wherein when the dimming signal DIM is lower than the threshold signal $V_{TH}$, the detected signal DET indicates that the system is under constant voltage (CV) mode, the first power supply voltage $V_{CC}$ and the first compensation signal CMP1 are blocked (are invalidated), the wireless control module (RF/MCU) 106 is powered by the second power supply voltage $V_{CV}$, and the control and drive circuit 112 generates the control signal Dr in response to the second compensation signal CMP2; and when the dimming signal DIM is higher than the threshold signal $V_{TH}$, the detected signal DET indicates that the system is under constant current (CC) mode, the second power supply voltage $V_{CV}$ and the second compensation signal CMP2 are blocked (are invalidated), the wireless control module (RF/MCU) 106 is powered by the first power supply voltage $V_{CC}$, and the control and drive circuit 112 generates the control signal Dr in response to the first compensation signal CMP1.

In one embodiment, the output current calculator 108 is configured to calculate the drive current in response to a current sense signal $I_{SEN}$, which is indicative of the current flowing through the main power switch 32.

In one embodiment, the threshold comparator 107 comprises a hysteresis comparator, which has a hysteresis coefficient.

When the dimming signal DIM is lower than the threshold signal $V_{TH}$, the detected signal DET indicates that the system is under constant voltage (CV) mode, a first voltage regulator (e.g. a low dropout regulator, LDO) 42 and the first error amplifier 110 are disabled, causing the first power supply voltage $V_{CC}$ and the first compensation signal CMP1 to be blocked. Then the wireless control module (RF/MCU) 106 is powered by the second power supply voltage $V_{CV}$ by way of a second voltage regulator (e.g. a low dropout regulator, LDO) 52. The difference between the second reference signal $V_{RCV}$ and the second power supply voltage $V_{CV}$ is amplified and integrated by the second error amplifier 111, and the second compensation signal CMP2 is delivered to the control and drive circuit 112, to provide a constant power supply voltage to the wireless control module 106.

When the dimming signal DIM is higher than the threshold signal $V_{TH}$, the detected signal DET indicates that the system is under constant current (CC) mode, the LDO 52 and the second error amplifier 111 are disabled, causing the second power supply voltage $V_{CV}$ and the second compensation signal CMP2 to be blocked. Then the wireless control module (RF/MCU) 106 is powered by the first power supply voltage $V_{CC}$ by way of the LDO 42. The difference between the first reference signal $V_{RCC}$ and the equivalent output current $I_{EQ}$ is amplified and integrated by the first error amplifier 110, and the first compensation signal CMP1 is delivered to the control and drive circuit 112, to control a constant current signal flow through the load (i.e. to control the brightness of the LED) and to provide a constant power supply voltage to the wireless control module 106.

In one embodiment, the second winding 104 and the first winding 31 are coupled in a forward way. That is, when the main power switch 32 is ON, an induced voltage generated across the second winding 104 is provided as the first power supply voltage $V_{CC}$ via a diode 41; and when the main power switch 32 is OFF, the induced voltage generated across the second winding 104 is blocked by the diode 41.

In one embodiment, the third winding 105 and the first winding 31 are coupled in a flyback way. That is, when the main power switch 32 is ON, an induced voltage generated across the third winding 105 is blocked by a diode 51; and when the main power switch 32 is OFF, the induced voltage generated across the second winding 104 is provided as the second power supply voltage $V_{CV}$ via the diode 51.

In one embodiment, the dimming signal DIM is input by users, which may be in a PWM form. As shown in FIG. 1, the LED driver 100 further comprises: a filter 113, configured to receive the dimming signal DIM, to convert the dimming signal DIM in the PWM form into an analog signal, so that the threshold comparator 107 compares the analog signal with the threshold signal $V_{TH}$ to generate the detected signal DET.

In the example of FIG. 1, the power converter 103 in the LED driver 100 comprises a flyback converter. The power converter 103 further comprises: a secondary winding 33, magnetically coupled to the first winding 31; and a secondary power switch 34, coupled between the secondary winding 33 and the load (LED) 1001.

In one embodiment, the reference signal generator 109 generates the first reference signal $V_{RCC}$ by multiplying the original reference voltage $V_{R0}$ with a duty cycle of the dimming signal DIM, i.e., the first reference signal $V_{RCC}$, the original reference voltage $V_{R0}$ and the duty cycle of the dimming signal DIM have a relationship as:

$$V_{RCC}=V_{R0}\times D_{DIM}$$

wherein $D_{DIM}$ represents the duty cycle of the dimming signal DIM.

The first reference voltage $V_{RCC}$ is delivered to the first error amplifier (EA) 110. When the dimming signal DIM is higher than the threshold signal $V_{TH}$ (i.e. the system is under constant current mode), an average of the equivalent output current $I_{EQ}$ is regulated to the first reference voltage $V_{RCC}$ by the first error amplifier (EA) 110, whereas the first reference voltage $V_{RCC}$ is set by users. When the dimming signal DIM is lower than the threshold signal $V_{TH}$ (i.e. the LED is turned off by users, and the system is under standby mode), the wireless control module (RF/MCU) 106 is powered by the second power supply voltage $V_{CV}$, which is regulated to the second reference signal $V_{RCV}$ by the second error amplifier (EA) 111.

Thus, the LED driver 100 precisely regulates the drive current of the LED during the LED lighting; and ensures the power supply voltage ($V_{PS}$) of the wireless control module (RF/MCU) 106 when the system is under standby mode. In addition, the LEDs are ensured to be turned off under standby mode if an appropriate relationship of the second reference signal $V_{RCV}$ and the turn ratio between the first winding 31 and the third winding 105 is set. Further, the power loss is reduced by decreasing the second reference signal $V_{RCV}$.

Figure 2:
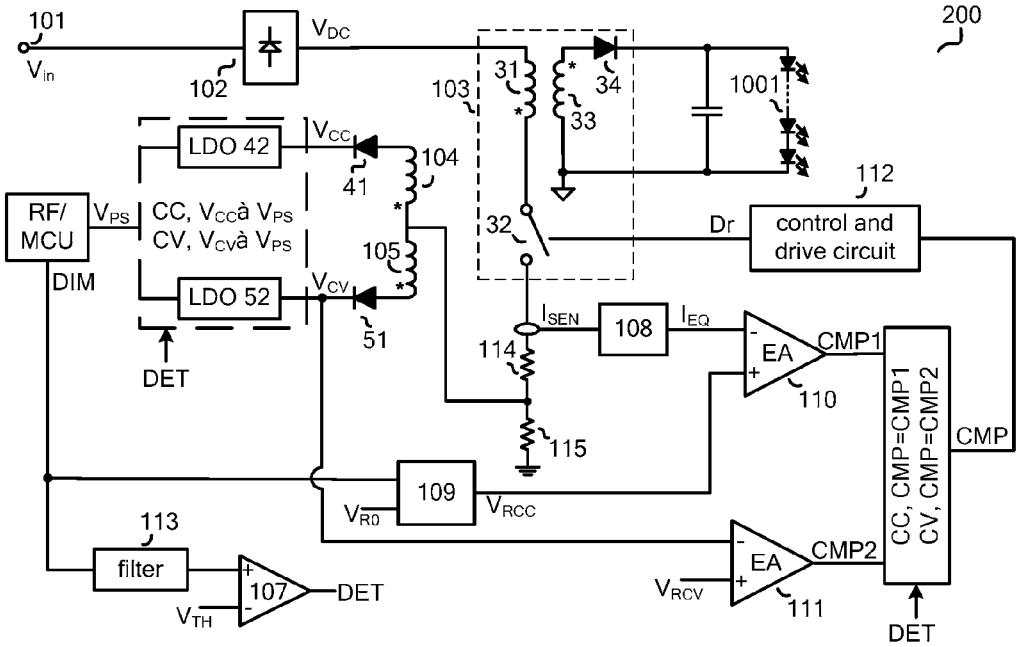
FIG. 2 schematically shows a LED driver 200 in accordance with an embodiment of the present invention.

FIG. 2 schematically shows a LED driver 200 in accordance with an embodiment of the present invention. The LED driver 200 in FIG. 2 is similar to the LED driver 100 in FIG. 1, with a difference that the LED driver 200 in FIG. 2 specifically shows the sense scheme of the current sense signal $I_{SEN}$. Specifically, the LED driver 200 in FIG. 2 further comprises: a first resistor 114 and a second resistor 115, series coupled between the main power switch 32 and a primary reference ground, wherein a voltage across the two series coupled resistors (114 & 115) is the current sense signal $I_{SEN}$, and wherein the second winding 104 and the third winding 105 are both coupled to the reference ground/primary reference ground by way of the second resistor 115. The voltage ($I_{SEN}$) across the two series coupled resistors (114 & 115) is then converted to the equivalent output current $I_{EQ}$ which reflects the load current by way of the output current calculator 108.

During the constant current mode operation, when the main power switch 32 is turned off, the current flowing through the main power switch 32 is zero; and when the main power switch 32 is turned on, the current flowing through the main power switch 32 is:

$$I_{32} = I_{Lm} + \frac{N2}{N1} \times I_{104} \tag{1}$$

wherein $I_{32}$ represents the current flowing through the main power switch, $I_{Lm}$ represents the current flowing through the magnetization inductor of the first winding 31, $I_{104}$ indicates the current flowing through the second winding 104, and N2/N1 is the turn ratio between the second winding 104 and the first winding 31.

Thus, the voltage across the two series coupled resistors (i.e. the current sense signal $I_{SEN}$) is:

$$I_{SEN}=I_{32}\times(R_{114}+R_{115})-I_{104}\times R_{115} \tag{2}$$

wherein $R_{114}$ represents the resistance of the first resistor 114, and $R_{115}$ represents the resistance of the second resistor 115.

According to equation (1) and equation (2), the current sense signal $I_{SEN}$ is:

$$I_{SEN} = I_{Lm} \times (R_{114} + R_{115}) + I_{104} \times \left[\frac{N2}{N1} \times R_{114} - \left(1 - \frac{N2}{N1}\right) \times R_{115}\right]$$

As a result, if the relationship of the turn ratio between the second winding 104 and the first winding 31, and the resistances of the first resistor 114 and the second resistor 115 is set as:

$$\frac{N2}{N1} \times R_{114} = \left(1 - \frac{N2}{N1}\right) \times R_{115} \tag{3}$$

Then $$I_{SEN} = I_{Lm} \times (R_{114} + R_{115}) \tag{4}$$

As can be seen from equation (4), if the relationship of the turn ratio between the second winding 104 and the first winding 31, and the resistances of the first resistor 114 and the second resistor 115 is particularly set as equation (3), the current sense signal $I_{SEN}$ is only related to the current flowing through the magnetization inductor of the first winding 31, but not affected by the current flowing through the second winding 104. The current sense signal $I_{SEN}$ is then converted to the equivalent output current $I_{EQ}$, so as to accurately reflect the current flowing through the LED 1001.

Consequently, the LED current loop and the power supply voltage loop are decoupled, which eliminates flickers of the LED.

The operation principle of the LED driver 200 in FIG. 2 is similar to the LED driver 100 in FIG. 1.

Figure 3:
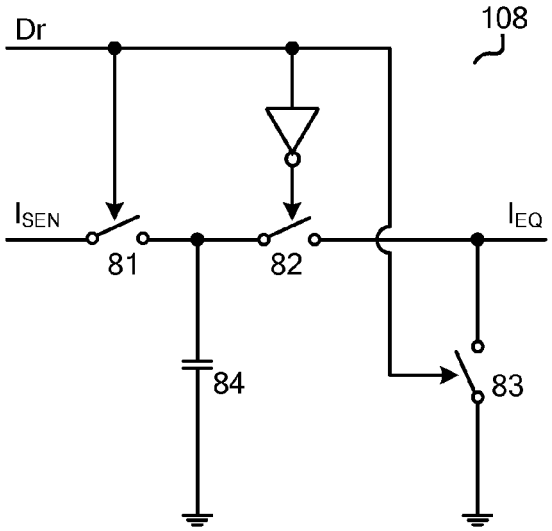
FIG. 3 schematically shows a circuit configuration of the output current calculator 108 in accordance with an embodiment of the present invention.

FIG. 3 schematically shows a circuit configuration of the output current calculator 108 in accordance with an embodiment of the present invention. In the example of FIG. 3, the output current calculator 108 comprises: switches 81-83 and a capacitor 84, wherein switches 81-83 are all controlled by the control signal Dr. When the main power switch 32 is ON, the switches 81 and 83 are ON, and the switch 82 is OFF. Accordingly, the equivalent output current $I_{EQ}$ is zero. When the main power switch 32 is OFF, the switches 81 and 83 are OFF, and the switch 82 is ON. Accordingly, the equivalent output current $I_{EQ}$ is the voltage across the capacitor 84, which is equal to a peak value of the current sense signal $I_{SEN}$.

Figure 4:
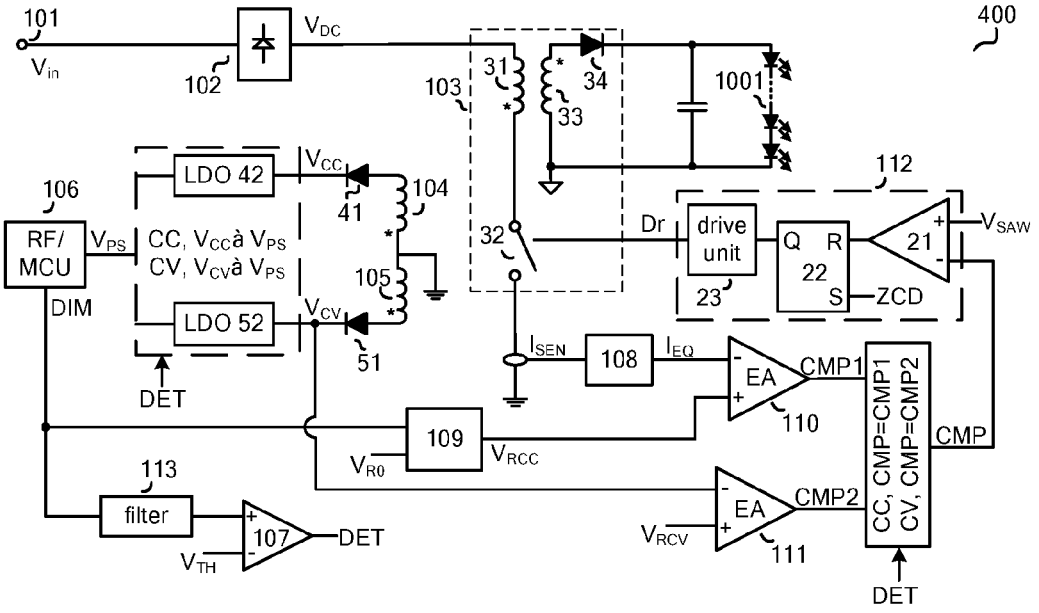
FIG. 4 schematically shows a LED driver 400 with a circuit configuration of the control and drive circuit 112 in accordance with an embodiment of the present invention.

FIG. 4 schematically shows a LED driver 400 with a circuit configuration of the control and drive circuit 112 in accordance with an embodiment of the present invention. In the example of FIG. 4, the control and drive circuit 112 comprises: a comparator 21, configured to receive the compensation signal CMP and a saw-tooth signal $V_{SAW}$, wherein the saw-tooth signal $V_{SAW}$ increases linearly when the main power switch 32 is ON, and is reset when the main power switch 32 is OFF, and wherein the comparator 21 is configured to generate a comparison signal by comparing the compensation signal CMP with the saw-tooth signal $V_{SAW}$; a RS flip-flop 22, configured to receive a zero crossing signal ZCD indicative of a zero crossing condition of a current flowing through the secondary power switch 34 and the comparison signal, to generate a logic signal, wherein the logic signal is set in response to the zero crossing signal ZCD and is reset in response to the comparison signal; and a drive unit 23, configured to receive the logic signal to generate the control signal Dr, so as to control the operation of the main power switch 32.

In one embodiment, the zero crossing condition is detected by the third winding 105.

The operation principle of the LED driver 400 in FIG. 4 is similar to the LED driver 100 in FIG. 1.

Figure 5:
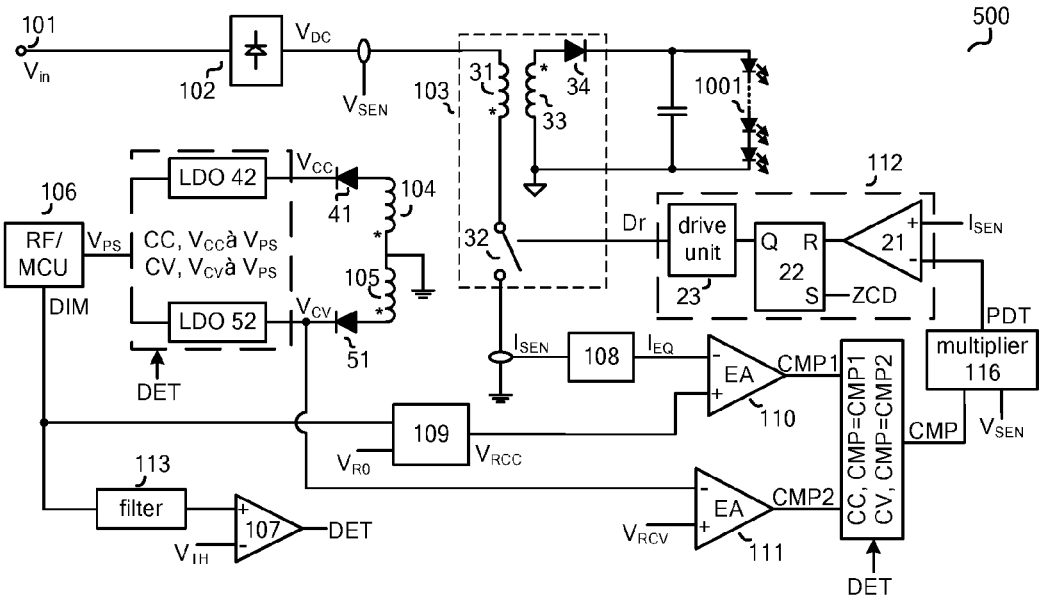
FIG. 5 schematically shows a LED driver 500 in accordance with an embodiment of the present invention.

FIG. 5 schematically shows a LED driver 500 in accordance with an embodiment of the present invention. The LED driver 500 is similar to the LED driver 100, with a difference that the LED driver 500 in FIG. 5 further comprises: a multiplier 116, configured to receive an input sense signal $V_{SEN}$ indicative of the AC input voltage $V_{in}$ (or the rectified signal $V_{DC}$) and the compensation signal CMP, to generate a product signal PDT by executing a multiplication operation on the input sense signal $V_{SEN}$ and the compensation signal CMP, so as to ensure the compensation signal CMP to be synchronized with the AC input voltage $V_{in}$, i.e. to synchronize the first compensation signal CMP1 and the second compensation signal CMP2 with the AC input voltage W.

In the example of FIG. 5, the circuit configuration of the control and drive circuit 112 is also shown. As shown in FIG. 5, the control and drive circuit 112 comprises: a comparator 21, configured to receive the product signal PDT and the current sense signal $I_{SEN}$, wherein the comparator 21 is configured to generate a comparison signal by comparing the product signal PDT with the current sense signal $I_{SEN}$; a RS flip-flop 22, configured to receive a zero crossing signal ZCD indicative of a zero crossing condition of a current flowing through the secondary power switch 34 and the comparison signal, to generate a logic signal, wherein the logic signal is set in response to the zero crossing signal ZCD and is reset in response to the comparison signal; and a drive unit 23, configured to receive the logic signal to generate the control signal Dr, so as to control the operation of the main power switch 32.

Several embodiments of the foregoing LED drivers (100, 200, 400 & 500) adopt an isolated power converter. However, one with ordinary skill in the art should realize that the power converter in the LED driver may also adopt a non-isolated power converter, as shown in FIG. 6.

Figure 6:
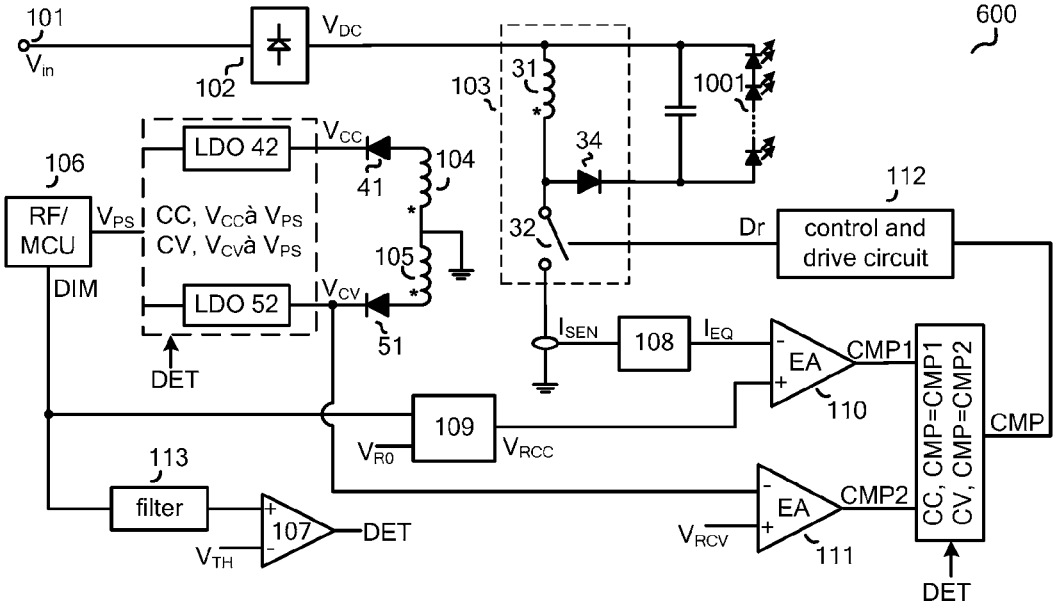
FIG. 6 schematically shows a LED driver 600 in accordance with an embodiment of the present invention.

FIG. 6 schematically shows a LED driver 600 in accordance with an embodiment of the present invention. In the example of FIG. 6, the power converter 103 in the LED driver 600 comprises a buck-boost converter. Specifically, the buck-boost converter comprises: a first winding 31; a main power switch 32, coupled to the first winding 31, wherein the first winding 31 is configured to store energy when the main power switch 32 is ON and is configured to release the energy to the load (LED) 1001 when the main power switch 32 is OFF; and a secondary power switch 34, coupled to the first winding 31 and the main power switch 32.

The operation principle of the LED driver 600 in FIG. 6 is similar to the LED driver 100 in FIG. 1.

In the previous embodiments of FIGS. 1-6, the first and second power supply voltages $V_{CC}$ and $V_{CV}$ are both delivered to the wireless control module (RF/MCU) by way of a LDO. However, one skilled in the art should realize that, the first and second power supply voltages $V_{CC}$ and $V_{CV}$ may also be delivered to the wireless control module (RF/MCU) by way of other appropriate circuits, or the first and second power supply voltages $V_{CC}$ and $V_{CV}$ may be delivered to the wireless control module (RF/MCU) directly.

Figure 7:
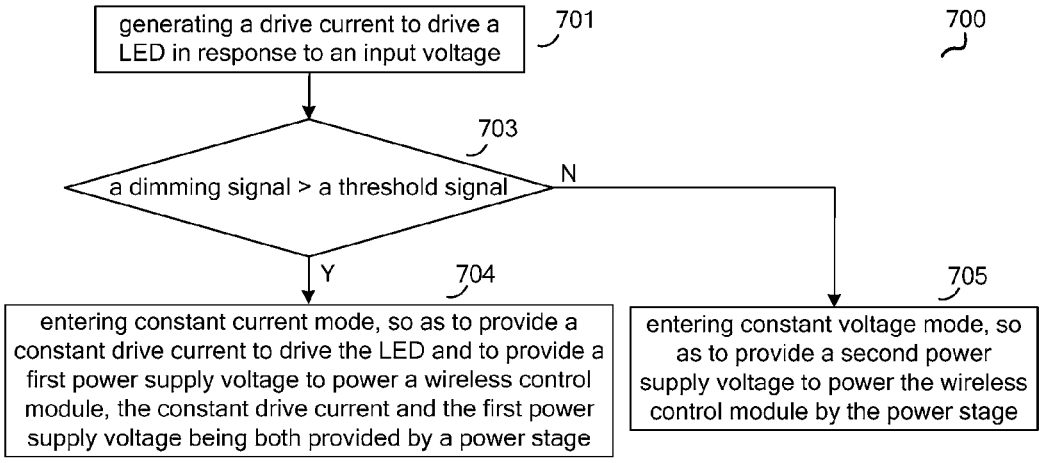
FIG. 7 schematically shows a flowchart 700 of a LED drive method in accordance with an embodiment of the present invention.

The present invention further provides a LED drive method. FIG. 7 schematically shows a flowchart 700 of a LED drive method in accordance with an embodiment of the present invention. The method comprises:

Step 701, generating a drive current to drive a LED in response to an input voltage.

Step 702, comparing a dimming signal with a threshold signal, to judge user's requirement: if the dimming signal is higher than the threshold signal, going to step 703; if the dimming signal is lower than the threshold signal, going to step 704.

Step 703, entering constant current mode, so as to provide a constant drive current to drive the LED and to provide a first power supply voltage to power a wireless control module, the constant drive current and the first power supply voltage being both provided by a power stage.

Step 704, entering constant voltage mode, so as to provide a second power supply voltage to power the wireless control module by the power stage.

In one embodiment, the dimming signal is input by users through the wireless control module.

In one embodiment, the power stage comprises: a first winding, a second winding and a third winding. When the system enters constant current mode, the first power supply voltage is provided by magnetically coupling the second winding to the first winding in a forward way. When the system enters constant voltage mode, the second power supply voltage is provided by magnetically coupling the third winding to the first winding in a flyback way.

In one embodiment, the power stage includes a main power switch, and wherein the LED drive method further comprises: deriving an equivalent output current indicative of the drive current; generating a first compensation signal in response to a first reference signal and the equivalent output current, the first reference signal being controlled by the dimming signal; generating a second compensation signal in response to a second reference signal and the second power supply voltage; and generating a control signal to control the main power switch in response to a) the first compensation signal when the dimming signal is higher than the threshold signal, or b) the second compensation signal when the dimming signal is lower than the threshold signal.

In one embodiment, the first reference signal is proportional to a duty cycle of the dimming signal.

Several embodiments of the foregoing LED driver provide better performance with only one power stage compared to conventional technique. Unlike the conventional technique, several embodiments of the foregoing LED driver adopt one power stage to provide a constant drive current to drive the load, and to provide different power supply voltages to power smart modules (e.g. the wireless control module) at different situations. In addition, the power stage adopted in several embodiments of the foregoing LED driver has very low standby power loss when the LED is turned off, which further improves the system performance.

It is to be understood in these letters patent that the meaning of "A" is coupled to "B" is that either A and B are connected to each other as described below, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

This written description uses examples to disclose the invention, including the best mode, and also to enable a person skilled in the art to make and use the invention. The patentable scope of the invention may include other examples that occur to those skilled in the art.

What is claimed is:

1. A LED driver, comprising:

a power converter, configured to provide a drive current to drive a load in response to an input voltage, the power converter including a first winding and a main power switch;

a second winding, magnetically coupled to the first winding to provide a first power supply voltage, the first power supply voltage being operable to power a wireless control module when a dimming signal is higher than a threshold signal;

a third winding, magnetically coupled to the first winding to provide a second power supply voltage, the second power supply voltage being operable to power the wireless control module when the dimming signal is lower than the threshold signal;

a first error amplifier, configured to generate a first compensation signal in response to a first reference signal and an equivalent output current indicative of the drive current, the first reference signal being controlled by the dimming signal;

a second error amplifier, configured to generate a second compensation signal in response to a second reference signal and the second power supply voltage; and a control and drive circuit, configured to generate a control signal to control the main power switch in response to a compensation signal, the compensation signal being the first compensation signal when the dimming signal is higher than the threshold signal, and the compensation signal being the second compensation signal when the dimming signal is lower than the threshold signal.

2. The LED driver of claim 1, further comprising:

a threshold comparator, configured to compare the dimming signal with the threshold signal.

3. The LED driver of claim 1, further comprising:

a multiplier, configured to execute a multiplication operation on an input sense signal indicative of the input voltage and the compensation signal to generate a product signal.

4. The LED driver of claim 3, wherein the power converter further includes a secondary power switch, and wherein the control and drive circuit comprises:

a comparator, configured to compare the product signal with a current sense signal indicative of a current flowing through the main power switch to generate a comparison signal;

a RS flip-flop, configured to generate a logic signal, wherein the logic signal is set in response to a zero crossing condition of a current flowing through the secondary power switch, and is reset in response to the comparison signal; and a drive unit, configured to generate the control signal in response to the logic signal, so as to control the operation of the main power switch.

5. The LED driver of claim 1, wherein the power converter further includes a secondary power switch, and wherein the control and drive circuit comprises:

a comparator, configured to compare the compensation signal with a saw-tooth signal, to generate a comparison signal, wherein the saw-tooth signal increases linearly when the main power switch is ON, and is reset when the main power switch is OFF;

a RS flip-flop, configured to generate a logic signal, wherein the logic signal is set in response to a zero crossing condition of a current flowing through the secondary power switch, and is reset in response to the comparison signal; and a drive unit, configured to generate the control signal in response to the logic signal, so as to control the operation of the main power switch.

6. The LED driver of claim 1, wherein the dimming signal is in a PWM form and has a duty cycle, and wherein the LED driver further comprises:

a reference signal generator, configured to multiply an original reference voltage with the duty cycle of the dimming signal, to generates the first reference signal.

7. The LED driver of claim 1, further comprising:

a first voltage regulator, configured to deliver the first power supply voltage to the wireless control module when the dimming signal is higher than the threshold signal; and a second voltage regulator, configured to deliver the second power supply voltage to the wireless control module when the dimming signal is lower than the threshold signal.

8. The LED driver of claim 1, wherein the dimming signal is in a PWM form, wherein the LED driver further comprises:

a filter, configured to convert the dimming signal into an analog signal.

9. The LED driver of claim 1, further comprising:

an output current calculator, configured to calculate the drive current in response to a current flowing through the main power switch, to generate the equivalent output current.

10. The LED driver of claim 9, further comprising: a first resistor and a second resistor, series coupled between the main power switch and a primary reference ground; wherein:

a voltage across the two series coupled resistors indicates the current flowing through the main power switch; and the second winding and the third winding are both coupled to the primary reference ground by way of the second resistor.

11. A LED drive method, comprising:

generating a drive current to drive a LED in response to an input voltage;

comparing a dimming signal with a threshold signal;

entering constant current mode if the dimming signal is higher than the threshold signal, so as to provide a constant drive current to the LED and to provide a first power supply voltage to power a wireless control module, the constant drive current and the first power supply voltage being both provided by a power stage; and entering constant voltage mode if the dimming signal is lower than the threshold signal, so as to provide a second power supply voltage to power the wireless control module by the power stage.

12. The LED drive method of claim 11, wherein:

the dimming signal is input by users through the wireless control module.

13. The LED drive method of claim 11, wherein the power stage comprises a first winding, a second winding and a third winding, and wherein:

the first power supply voltage is provided by the second winding; and the second power supply voltage is provided by the third winding.

14. The LED drive method of claim 11, wherein the power stage includes a main power switch, and wherein the LED drive method further comprises:

deriving an equivalent output current indicative of the drive current;

generating a first compensation signal in response to a first reference signal and the equivalent output current, the first reference signal being controlled by the dimming signal;

generating a second compensation signal in response to a second reference signal and the second power supply voltage; and generating a control signal to control the main power switch in response to a) the first compensation signal when the dimming signal is higher than the threshold signal, or b) the second compensation signal when the dimming signal is lower than the threshold signal.

15. The LED drive method of claim 14, wherein:

the first reference signal is proportional to a duty cycle of the dimming signal.

16. A LED driver, comprising:

a power converter including a main power switch, configured to provide a drive current to drive a load, a first power supply voltage to power a wireless control module when a dimming signal is higher than a threshold signal, and a second power supply voltage to power the wireless control module when the dimming signal is lower than the threshold signal; and a control and drive circuit, configured to control the main power switch based on a first reference signal and an equivalent output current indicative of the drive current when the dimming signal is higher than the threshold signal, and to control the main power switch based on a second reference signal and the second power supply voltage when the dimming signal is lower than the threshold signal.

17. The LED driver of claim 16, further comprising:

a threshold comparator, configured to compare the dimming signal with the threshold signal.

18. The LED driver of claim 16, wherein the dimming signal is in a PWM form and has a duty cycle, and wherein the LED driver further comprises:

a reference signal generator, configured to multiply an original reference voltage with the duty cycle of the dimming signal to generates the first reference signal.

19. The LED driver of claim 16, further comprising:

an output current calculator, configured to calculate the drive current in response to a current flowing through the main power switch, to generate the equivalent output current.

20. The LED driver of claim 16, further comprising:

a first error amplifier, wherein the first reference signal and the equivalent output current are delivered to the control and drive circuit by way of the first error amplifier; and a second error amplifier, wherein the second reference signal and the second power supply voltage are delivered to the control and drive circuit by way of the second error amplifier.

* * * * *